US006889398B2

(12) United States Patent
Lewis

(10) Patent No.: US 6,889,398 B2
(45) Date of Patent: May 10, 2005

(54) COIL SPRING CONTAINING MATTRESS AND METHOD

(75) Inventor: Nels V. Lewis, Portland, OR (US)

(73) Assignee: Paramount Bedding, Inc., Tualatin, OR (US)

( * ) Notice: Subject to any disclaimer, the term of this patent is extended or adjusted under 35 U.S.C. 154(b) by 0 days.

(21) Appl. No.: 10/174,902

(22) Filed: Jun. 17, 2002

(65) Prior Publication Data

US 2003/0229943 A1 Dec. 18, 2003

(51) Int. Cl.[7] ..... A47C 23/04
(52) U.S. Cl. ..... 5/716; 5/717; 5/910
(58) Field of Search ..... 5/716, 718, 721, 5/717, 709, 910

(56) References Cited

U.S. PATENT DOCUMENTS

| | | | | | |
|---|---|---|---|---|---|
| 2,779,034 | A | * | 1/1957 | Arpin | 5/709 |
| 2,826,769 | A | * | 3/1958 | Drews | 5/717 |
| 2,940,089 | A | * | 6/1960 | Koenigsberg | 5/717 |
| 3,099,021 | A | * | 7/1963 | Wetzler | 5/717 |
| 3,166,768 | A | * | 1/1965 | Cunningham | 5/718 |
| 3,262,135 | A | * | 7/1966 | Fasanella | 5/717 |
| 3,618,146 | A | * | 11/1971 | Ferdinand | 5/717 |
| 3,822,426 | A | * | 7/1974 | Mistarz | 5/717 |
| 3,935,048 | A | | 1/1976 | Rucker | |
| 3,935,690 | A | | 2/1976 | Lea et al. | |
| 3,942,299 | A | | 3/1976 | Bory | |
| 3,943,686 | A | | 3/1976 | Crawford et al. | |
| 3,946,929 | A | | 3/1976 | Armetti | |
| 3,958,390 | A | | 5/1976 | Pringle, Jr. et al. | |
| 3,964,232 | A | | 6/1976 | Bender et al. | |
| 3,964,235 | A | | 6/1976 | Miller et al. | |
| 3,967,433 | A | | 7/1976 | Bonfiglioli | |
| 3,972,153 | A | | 8/1976 | Kiellarson et al. | |
| 3,973,372 | A | | 8/1976 | Omori | |
| 3,977,153 | A | | 8/1976 | Schrenk | |
| 3,981,033 | A | * | 9/1976 | Toda | 5/717 |
| 3,986,921 | A | | 10/1976 | Putnam, Jr. et al. | |
| 4,031,815 | A | | 6/1977 | Verbeke | |
| 4,040,237 | A | | 8/1977 | O'Brien | |
| 4,043,098 | A | | 8/1977 | Putnam, Jr. et al. | |
| 4,067,076 | A | * | 1/1978 | Krier | 5/717 |
| 4,079,574 | A | | 3/1978 | Monguzzi et al. | |
| 4,084,390 | A | | 4/1978 | Schmachtel et al. | |
| 4,098,404 | A | | 7/1978 | Markert | |
| 4,106,262 | A | | 8/1978 | Aterianus | |
| 4,106,265 | A | | 8/1978 | Aterianus | |
| 4,110,954 | A | | 9/1978 | Olsson et al. | |
| 4,114,530 | A | | 9/1978 | Miller | |
| 4,128,985 | A | | 12/1978 | Simmons | |
| 4,134,245 | A | | 1/1979 | Stella | |
| 4,144,693 | A | | 3/1979 | Ogata | |

(Continued)

OTHER PUBLICATIONS

The cover letter accompanying this PTO Form 1449 and the information set forth therein.

Sleeper Cab Bedding brochure, published more than one year before the filing date of the present application.

U.S. Appl. No. 09/793,280, filed Feb. 28, 2001, to Lewis et al., entitled "Method and Apparatus for Compressing a Mattress with an Inner Coil Spring".

*Primary Examiner*—Alexander Grosz
(74) *Attorney, Agent, or Firm*—Klarquist Sparkman, LLP

(57) ABSTRACT

A coil spring containing mattress comprises a coil spring encased in a sealed container or casing. One or more compressible pads may be included within the casing. Desirably, these pads are of an open-celled foam material which may be compressed in response to applied pressure. Air may be allowed to flow from the mattress to facilitate compression of the mattress and then blocked to assist in maintaining the mattress in a compressed state, for example for shipment.

33 Claims, 4 Drawing Sheets

U.S. PATENT DOCUMENTS 4,144,697 A 3/1979 Suga
4,164,177 A 8/1979 Canfield
4,165,594 A 8/1979 Corbic
4,167,435 A 9/1979 Olschewski
4,171,605 A 10/1979 Putnam, Jr. et al.
4,180,256 A 12/1979 Coast
4,183,193 A 1/1980 Klingelhofer et al.
4,183,515 A 1/1980 Coast
4,190,146 A 2/1980 Knuchel
4,195,723 A 4/1980 Loewenthal
4,223,508 A 9/1980 Wells
4,223,512 A 9/1980 Buchner
4,245,829 A 1/1981 Coast
4,251,975 A 2/1981 Krein
4,287,702 A 9/1981 Corbic
4,288,965 A 9/1981 James
4,291,460 A 9/1981 Stoehr
4,295,922 A 10/1981 Evers
4,328,655 A 5/1982 Spencer et al.
4,355,712 A 10/1982 Bruno
4,372,097 A 2/1983 Wyslotsky
4,381,637 A 5/1983 Ballestrazzi et al.
4,391,081 A 7/1983 Kovacs
4,418,513 A 12/1983 Plahm
4,418,514 A 12/1983 Spann
4,424,659 A 1/1984 Perigo et al.
4,445,241 A 5/1984 Ender et al.
4,483,125 A 11/1984 Suga
4,525,977 A 7/1985 Matt
4,532,753 A 8/1985 Kovacs
4,537,016 A 8/1985 Shanklin et al.
4,549,386 A 10/1985 Wilson
4,561,925 A 12/1985 Skerjanec et al.
4,563,862 A 1/1986 McElvy
4,592,193 A 6/1986 Gustavsson
4,631,899 A 12/1986 Nielsen
4,633,654 A 1/1987 Sato et al.
4,711,067 A 12/1987 Magni
4,727,707 A 3/1988 Hadden
4,757,668 A 7/1988 Klinkel et al.
4,964,259 A 10/1990 Ylvisaker et al.
5,062,172 A 11/1991 Stewart
5,469,590 A * 11/1995 Simon ..... 5/716
5,675,855 A 10/1997 Culp
5,704,085 A * 1/1998 Sabalaskey ..... 5/721
5,953,778 A * 9/1999 Hiatt ..... 5/716
6,023,803 A * 2/2000 Barman ..... 5/716
6,128,798 A 10/2000 Barman et al.
6,199,234 B1 * 3/2001 Srour et al. ..... 5/716
6,484,338 B1 * 11/2002 Hagglund ..... 5/716
6,739,107 B1 5/2004 Lewis et al.

* cited by examiner

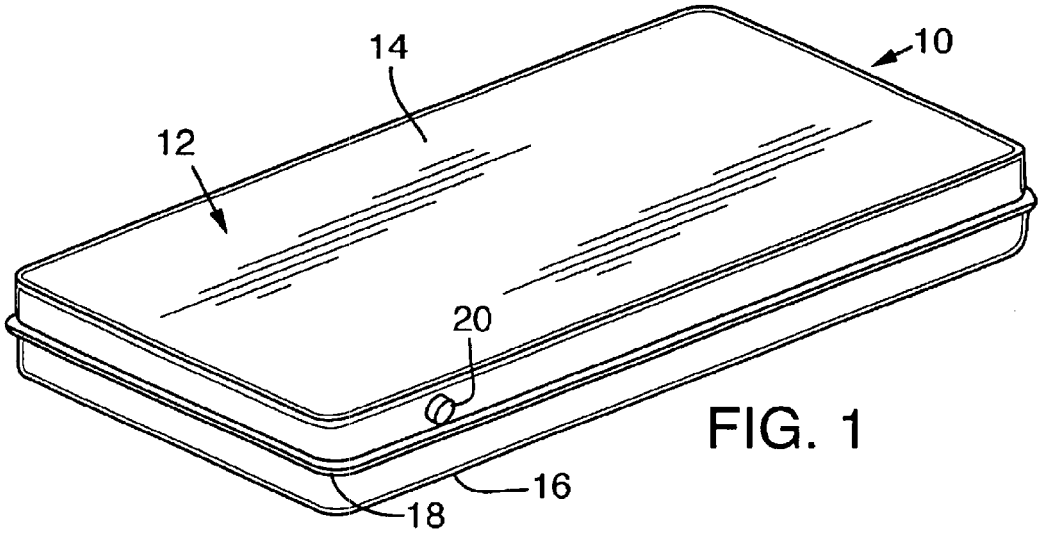
FIG. 1
FIG. 2
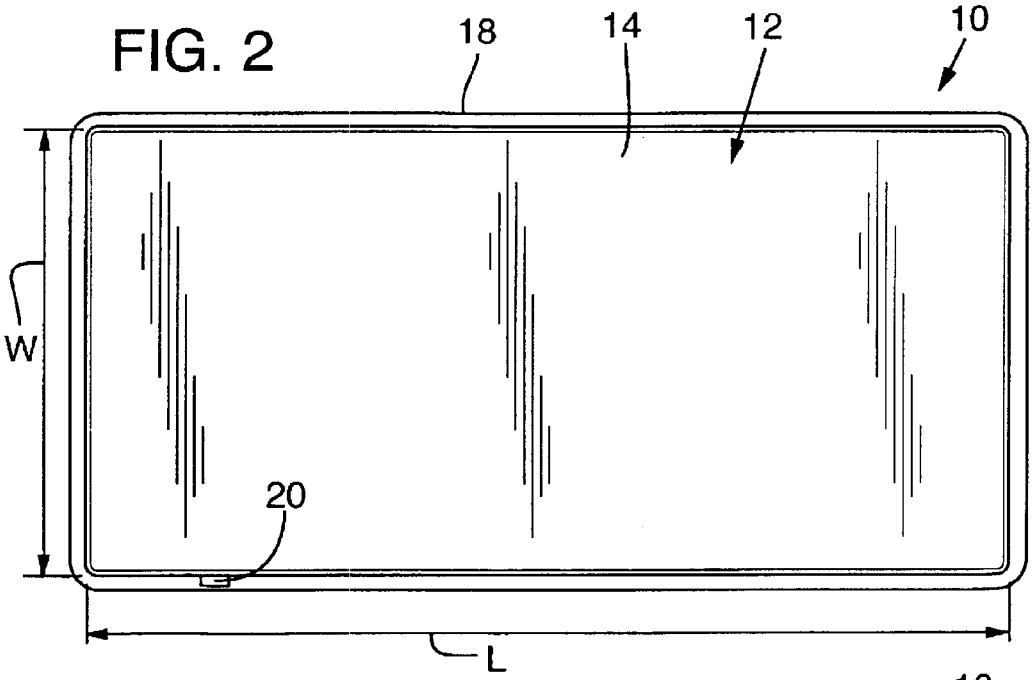
FIG. 3
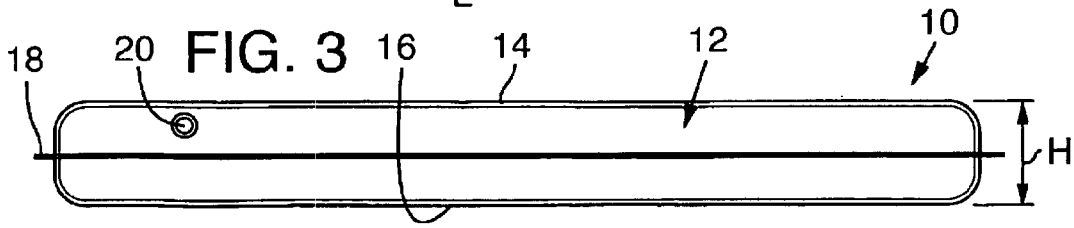

COIL SPRING CONTAINING MATTRESS AND METHOD

The present invention relates to a coil spring containing mattress and to methods relating to making and shipping such mattresses.

BACKGROUND

Coil spring containing mattresses are known which have an internal coil spring with or without a pad on top of the spring and with the mattress typically being encased in an air-permeable fabric cover. Mattresses of this type are typically bulky. This bulk makes it expensive to ship these mattresses over long distances.

A need exists for an improved coil spring mattress and associated methods.

SUMMARY

In accordance with a first embodiment, a coil spring has first and second major opposed surfaces. A first pad of a compressible material at least partially overlays the first major surface and more desirably overlays the entire first major surface. In a specific embodiment, the first pad comprises a foam pad of a polymer material and more desirably comprises open-celled foam material which is capable of compression in response to the application of pressure and expansion upon the relief of pressure. A container comprised of a flexible material contains and seals the coil spring and first pad within the container so as to restrict the flow of air into and out of the mattress. A valve is coupled to the container and is selectively operable to permit the ingress and egress of air into and out of the container when the valve is in an open position and to block the ingress and egress of air into and out of the container when the valve is in a closed position. The valve may be a simple cap over an opening although more complex valve structures may be used.

Air may be removed through the open valve such as by compressing the mattress. By closing the valve with the mattress compressed, the reintroduction of air into the mattress is blocked to maintain the mattress in a compressed state. When the valve is reopened, the mattress then expands to its uncompressed size. The valve may then be closed to block the egress of air from the mattress so that the mattress remains expanded. Multiple mattresses may be compressed in this manner and stacked for shipment, such as thirty or more of the compressed mattresses being stacked on top of one another on a pallet. Air may be removed by applying pressure to the mattress with the valve open to cause air to flow outwardly through the open valve.

In accordance with an alternative embodiment, a second compressible pad, which may also be of an open-celled foam material, may be positioned to at least partially over the second major surface of the coil spring. Desirably the second pad overlies the entire second major surface. Like the first pad, the second pad may be compressible upon the application and pressure with the second pad expanding upon the relief of pressure. Both the first and second pads may have a cross-sectional area which is greater than the cross-sectional area of the first and second major surfaces of the coil spring. Although variable, in one desirable form, the pads are of foam and range in thickness from ¾ inch to 1¼ inch.

As another aspect of an embodiment, optional intermediate layers may be positioned between the major surfaces of the coil spring and the respective first and second pads.

These intermediate layers may, for example, comprise a net which may encase the coil spring. In an alternative form, the layers may comprise sheets of a fibrous material such as sheets comprised of non-woven polymer fibers.

As a specific desirable option, the first and second pads may comprise foam pads of a material which allows the pads to compress to 25 percent of their uncompressed thickness when subjected to a force in the range from 33 to 43 pounds per square inch and more desirably in response to pressure from 37 to 43 pounds per square inch. The foam pads may also be capable of elongation, such as in the amount of 120 percent, without tearing. Also, the foam pad and other materials forming the mattress may be and desirably will be comprised of fire retardant material.

As another aspect of an embodiment, the coil spring may have a first width with the first foam pad being of a width which is greater than the first width.

The coil spring may comprise opposed sides extending between the first and second major opposed surfaces and opposed ends extending between the first and second major surfaces. The mattress may comprise a first support comprised of a compressible material which extends at least partially along the sides and ends of the coil spring. Desirably, the first support entirely surrounds the sides and ends of the coil spring. The first support may comprise foam material, such as open-celled foam. In addition, the mattress may comprise a second support comprised of a compressible material positioned within the coil spring. The second support may also be comprised of open-celled foam material. The coil spring may have a longitudinal axis and the second support may have a cross portion extending at least partially in a direction which is skewed relative to the longitudinal axis. The second support may comprise, in a specific example, plural spaced apart elongated cross members extending in a direction which is skewed with respect to, and in a specific form perpendicular to, the longitudinal axis. These cross members may be in the shape of bars which extend at least a portion of the distance between the opposed sides of the coil spring and in a specific form extend fully across the distance between such opposed sides. The second support may be located at locations spaced inwardly from the respective ends of the coil spring and may comprise plural spaced apart support members or bars positioned at such inwardly spaced locations. As a specific aspect of an embodiment, the second support may be of height which is less than the height of the coil spring. In addition, the first and second supports may be comprised of a support material having a density which is greater than the density of the first pad. In addition, the support material may have a resistance to compression in response to applied pressure which is greater than the resistance of the first pad to compression in response to applied pressure.

As another aspect of an embodiment, the first support may comprise upper edge portions with the first pad overlying the upper edge portions of the first support. In this example, a pad may be eliminated at the second major surface of the coil spring. One or more optional first layer may be disposed intermediate to the first pad and the first major opposed surface and one or more optional second layers may be positioned adjacent to the second major opposed surface of the coil spring. These intermediate layers may abut the respective major surfaces of the coil spring.

The container, in accordance with one embodiment, may comprise a casing which is heat-sealed. For example, the casing may be formed of two sheets surrounding the contents of the mattress and with peripheral edges of the sheets abutting one another. The abutting edges of the sheets may be heat sealed together about the periphery of the mattress along a border. Other sealing approaches and casing constructions may be used. Desirably the valve is located in one of the sheets at a position where the valve ends up along a side of the mattress when the mattress is expanded to its fully expanded state.

In an aspect of one embodiment having a first support along the first and second sides of the coil spring, the width of the supports adjacent to the first and second sides of the coil spring may be of a first dimension for a mattress of a first width and of a second dimension greater than the first dimension for a mattress of a second width greater than the first width. That is, in this aspect of an embodiment, the width of the mattress may be increased by increasing the width of the first support portions along the sides of the mattress rather than increasing the width of the coil spring.

Embodiments of methods of making and shipping such mattresses are also disclosed.

The present invention relates to novel and non-obvious aspects of mattresses and methods alone and in various combinations and subcombinations with one another as set forth in the claims below. The present invention is not limited to mattresses and methods having all or any specific subcombination of the characteristics described herein in combination with one another.

BRIEF DESCRIPTION OF DRAWINGS

FIG. 1 is a perspective view of one form of a mattress in accordance with an embodiment.

FIG. 2 is a top view of the mattress of FIG. 1.

FIG. 3 is a side elevation view of the mattress of FIG. 1.

DETAILED DESCRIPTION

Figure 4:
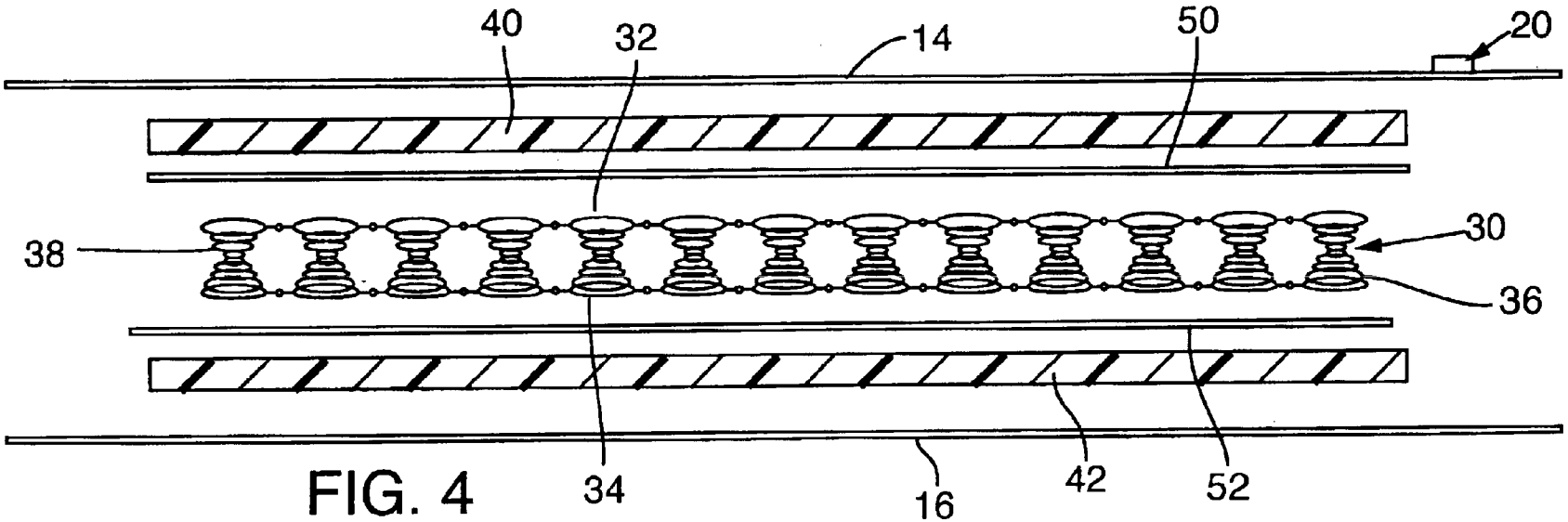
FIG. 4 is a longitudinal sectional view through one form of a mattress.

FIGS. 1–3 illustrate one embodiment of a mattress 10. The mattress 10 may be of any convenient shape and is shown as a generally rectangular mattress in these figures. The illustrated mattress has a length L, a width W and height H. Although variable, in one specific example, the mattress may be about 7 inches high, about 80 inches long and come in a variety of widths such as 34 inch, 36 inch, 38 inch and 39 inch. The overall height of the mattress will depend on, for example, the thickness of components used in constructing the mattress. The mattress 10 is comprised of an outer container or casing 12 comprised of a flexible material to allow the mattress to collapse as explained below, when the mattress is compressed. The illustrated casing 12 is formed of respective top and bottom sheets 14,16 which are sealed together about the periphery of the mattress at a border 18. For example, sheets 14 and 16 may be comprised of material which is heat sealed to bond these materials together at the border. Adhesive or other sealing approaches may be used. Desirably, the casing is formed of a material which restricts the passage of air from the interior to the exterior of the sealed casing with the casing enclosing the mattress components therein.

Although other materials may be used, a heat weldable polymer material is desirable. This material may be of multicomponent construction. For example, it may comprise an outer layer of polyester with an inner layer of polyvinylchloride. A specific exemplary material is 600 denier by 300 denier polyester with a 4-mil PVC backing. Polyurethane is another exemplary material. The heat sealing may be accomplished by any suitable approach, such as RF welding. The sheets 14 and 16 may be overlaid at their periphery and welded with a border being left outside the weld line, such as a ⅛ inch to ¼ inch border. An exemplary weld location is shown at 17 in FIG. 5. Other constructions are equally suitable. For example, the sheets 14 and 16 may be one continuous sheet which is folded to capture the mattress components therebetween and then sealed along three sides. As yet another example, an envelope construction may be used to form the casing. Alternatively, the edges of the sheet may overlap one another rather than being positioned in an abutting back-to-back relationship. In general, any suitable air impermeable container may be used which is constructed to permit the mattress to collapse.

The container or casing 12 is provided with a valve 20 which selectively opens and closes a passageway or opening leading to the interior of the casing. When the valve 20 is open, air may be removed from the casing. Conversely, when valve 20 is closed, the passage of air through the valve is blocked. The valve may be a simple opening with a cap that is removed to expose the opening to the ambient air and returned to close the opening. Alternatively, the valve may take a more complex configuration. Commercially available valves may be used, such as those used in self-inflating pads used in backpacking in similar applications. One form of exemplary valve is used in a Model No. 57979 Rogue brand backpacking pad available from Paramount Bedding, Inc. of Damascus, Oreg. An exemplary valve of this type has a PVC flange with an ABS cap and ABS threads onto which the cap is threaded. The cap is loosened or removed to allow passage of air through the valve. This type of valve may be heat welded or otherwise secured to one of the sheets forming the casing 12. In FIG. 1, valve 20 is shown secured to sheet 14. Desirably, the valve is positioned in the sheet such that the valve is positioned along a side of the mattress when the mattress is in its uncompressed state, such is shown in FIG. 1. For example, for a seven inch high mattress, the valve may be positioned within 1½ inch of the welded edge of the mattress so that the valve ends up at a side of the mattress when the mattress is uncompressed. The valve 20 is not limited to a single valve, although this is a desirable construction. For example, a pair of one way ingress and egress valves may be used. In general, the term valve is broadly construed to mean any structure operable to control the flow of air into and out of the mattress casing.

With reference to FIGS. 4–7, the illustrated mattress 12 comprises at least one coil spring 30 which may have any number of rows and columns of coils in the spring. The spring shown in FIGS. 4 and 5 have 13 rows of coils (see FIG. 4) and 8 columns of coils (see FIG. 5) in the spring. The illustrated spring 30 comprises respective upper and lower major surfaces 32,34 which are parallel to and opposed to one another. In addition, spring 30 comprises first and second ends 36,38 and first and second sides 40,42. The spring 30 may be of an open construction in which case the ends and sides are open as only the framework, if any, of the spring exists at such locations. The respective ends and sides of the spring extend between the surfaces 32 and 34. If the mattress is of another shape, it may technically not have a portion which could be described as end. However, the term side is to be construed as encompassing these other configurations (e.g., the portions of a circular shaped mattress between the major surfaces). As a specific example, the spring 30 may comprise a Bonnel RE (roll edge) spring of 13 gauge wire. This type of spring may have four U-shaped cap pieces, one at the top and bottom of each end of the spring, and may be borderless in that elongated border pieces extending lengthwise of the mattress and between the respective cap pieces may be eliminated.

Springs of this type may be of a variable width and height with a specific example being about 5½ inches high by 37½ inches wide and 78½ inches long for a 7 inch high, 39 inch wide, and 80 inch long finished mattress. Alternatively, the width may be made constant even though the overall width of the mattress varies. For example, a spring may be 28 inches wide for mattresses of varying widths such as 34 inches wide, 36 inches wide, 38 inches wide and 39 inches wide. In such a case, the overall width of the mattress may be made up by adding padding or reinforcing elements, which may be of foam, of the desired thickness along the sides of the mattress. Desirably, the mattress comprises at least one compressible pad positioned to at least partially overlay one of the major surfaces of the coil spring. More desirably, the compressible pad overlies the entire major surface of the coil spring. For example in FIG. 4, a pad 40 is shown overlaying the major surface 32 of coil spring 30. In addition, in the construction shown in FIG. 4, a second pad 42 is shown overlaying the second major opposed surface 34. Pad 42 may overlay the entire surface 34 or only a portion thereof, although this would be less desirable. In the construction shown in FIG. 7 the lower pad 42 has been eliminated. The pads 40,42 desirably are of a foam material with some resiliency and memory. As a specific example, pads 40,42 may be of an open-celled foam material such as polyurethane. Although variable, the thickness of the foam pads 40,42 in specific desirable examples range from about ¾ inch to about 1¼ inch, with one inch thick foam being a particularly desirable example. In addition, in certain applications a self-extinguishing fire retardant foam may be used such as a foam which has met the criteria to pass MVSS-302 fire resistance when tested under ASTM Standard 3453. The other components of the mattress may have similar fire retardant properties. Also, a typical foam is capable of elongating a limited extent without tearing. As one specific example, a desirable foam may have the capacity of 120 percent elongation without tearing when tested pursuant to ASTM Standard 3574. The extent to which the foam elongates without tearing may be varied.

The compressibility and density of the foam may be varied to suit a user's comfort. For example, the foam may compress to at least twenty-five percent of its uncompressed thickness in response to applied pressure. In one specific desirable example, the density of pad 40 ranges from 1.4 to 1.5 pounds per cubic foot with the foam being identified as 38 ILD (indention load deflection) polyurethane foam. In addition, this foam may have a compressibility such that it compresses to 25 percent of its thickness in response to 37 to 43 psi pressure applied per ASTM Standard 3574 (the 37 psi being applied to the 1.4 pound per cubic foot density foam and the 43 psi being applied to 1.5 pound cubic foot density foam). The pad 42 may be of a different type of foam or material having compressibility characteristics which differ from pad 40. However, for a two-sided mattress, the pads 40 and 42 may be of the same material so that the mattress has the same properties whichever side is up.

Figure 5:
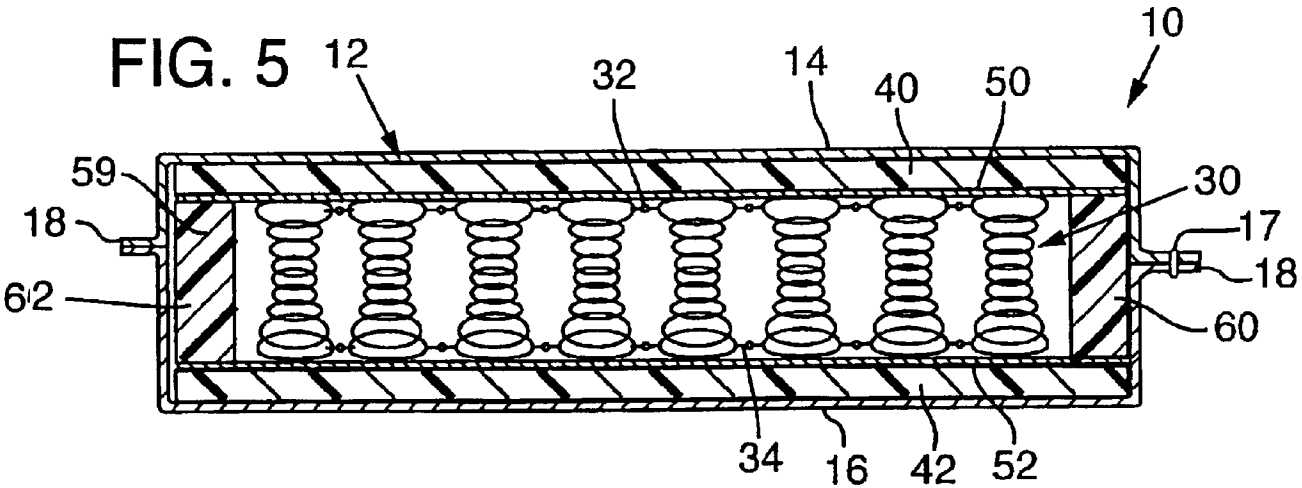
FIG. 5 is a transverse sectional view through an alternative form of a mattress.

To illustrate the variability of this construction, the pad 40 in FIG. 5 may be of a more easily compressible material than pad 40 in FIG. 4. For example, pad 40 in FIG. 5 may be of a foam having a density of 1.45 pounds per cubic foot and which compresses to 25 percent of its thickness in response to an applied force of 33 pounds per square inch pursuant to ASTM Standard 3574.

One or more optional layers 50,52 may be positioned to overlie the major surfaces 32,34 of coil spring 30. Either or both of these sheets may be eliminated and they may extend only over a portion of the respective major surface. Desirably, such layers overlie the entire coil spring major surface with which they are associated and each such layer may also abut the respective associated major surface of the coil spring. The layers 50,52 may comprise insulator pads and may be fire retardant in the same manner as the pads themselves in applications where fire retardancy is desired. In one specific example, sheets 50,52 comprise non-woven fibrous sheets of an insulating material such as two ounce per square inch heat-bonded polyester fibers. Alternatively, the sheets 50,52 may be comprised of a portion of a net which encases the spring 30 with a net being made of non-woven fibrous material as well. Typically, the foam is made thicker (e.g., by ¼ of an inch per side) if a net is used instead of sheet material. It should be noted that the mattress is not limited to the number or positioning of the layers shown in the figures. For example, additional layers may be added, although this would be optional.

The form of mattress shown in FIG. 5 comprises a first support 59 extending at least partially along the respective sides of the mattress and more desirably at least partially along the respective sides and ends of the mattress. These first supports may entirely surround the mattress and are positioned within the casing 12. Desirably, the supports are comprised of a compressible material and may have a greater resistance to compressibility and a higher density than the foam top pad 40 in FIG. 5. In one specific form, the first supports comprise side portions 60,62 and, in the form shown in FIG. 6, respective end portions 64,66. The side portions 60,62 and end portions 64,66 in effect define a nest or recess within which the coil spring 30 may sit. Components 60,62 and 64,66 may be formed of a plurality of individual components and may each be of multi-piece construction. Alternatively, to provide additional rigidity to the mattress, the components 60,62,64 and 66 may be of a monolithic integral one-piece construction. For example, the center may be severed from a block of foam leaving a rectangular perimeter comprised of components 60,62,64 and 66. Alternatively, this first support structure may be molded or otherwise formed. As mentioned above, a first support comprised of member 60,62,64 and 66 may be of a higher density and reduced compressibility in comparison to the foam top piece 40 in the FIG. 5 construction. For example, an open-celled foam material may be used of the same substance as top piece 40, as one example, but having a density of 1.8 pounds per cubic foot and a compressibility such that it compresses to 25 percent of its thickness in response to an applied force of 45 psi. In contrast, in this example, the pad 40 may be comprised of a material having a density of 1.45 pounds per cubic foot and which compresses to twenty-five percent of its thickness in response to an applied force of 33 pounds per square inch and be 1.5 inch thick when uncompressed. In addition, the sides may be of a greater density and lesser compressibility than the end components. For example, when a mattress is placed in a vehicle, it is not unusual for the mattress to be positioned transversely relative to the longitudinal axis of the cab of a vehicle. In this case, the user of the mattress may sit at the side of the mattress, or get on and off the mattress from the side, as the side is exposed to the interior of the vehicle. Consequently, by reinforcing the side to a greater extent, the durability and support provided by the mattress at such a heavily used location is increased. Although not required, desirably the first support, in this example the component 60,62,64 and 66 are of the same height as the height of the coil spring. In addition, top pad 40 in the illustrated FIG. 5 construction may overlay the upper edges of components 60,62,64 and 66 as can be best seen in FIG. 6.

Figure 6:
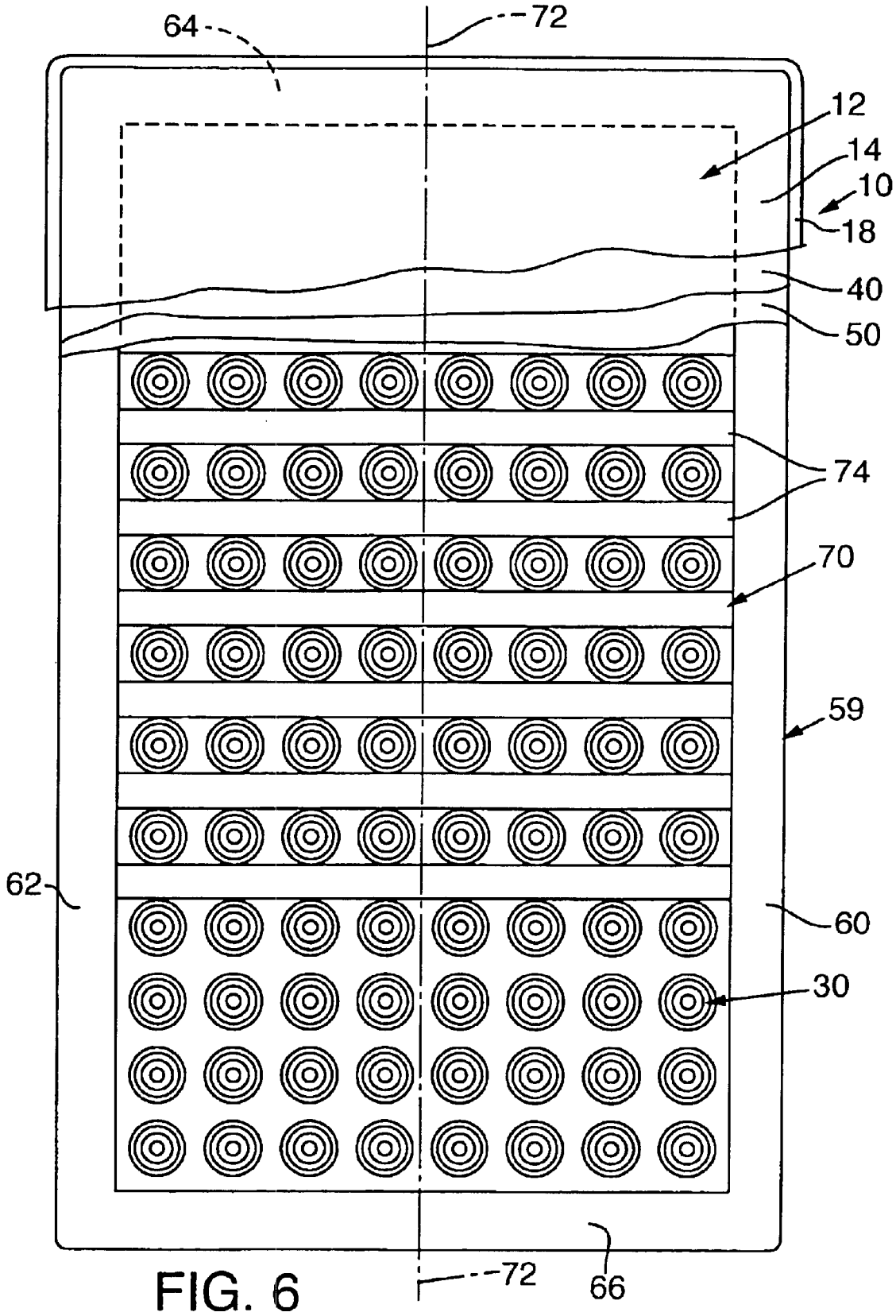
FIG. 6 is a partially broken away top view of the FIG. 5 form of mattress.
Figure 7:
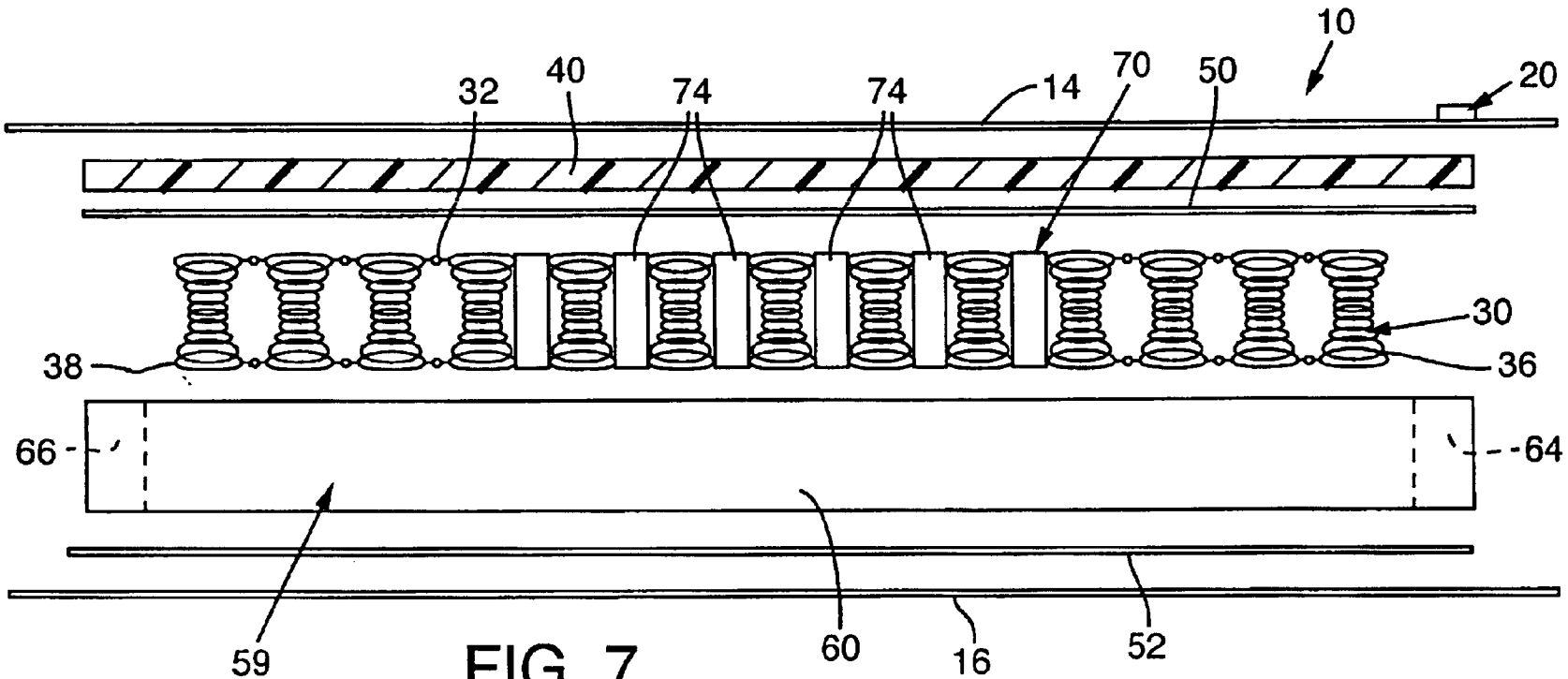
FIG. 7 is a partially broken away exploded view of the FIG. 6 form of mattress.

In certain embodiments, such as shown in FIG. 6, a second support may be provided within the coil spring to provide further support to the mattress at selected locations of the mattress. Desirably, the second support may comprise one or more cross supports of a compressible material so that they may be compressed with the mattress for shipment. In FIG. 6, an elongated rectangular mattress is shown having a longitudinal axis indicated by the dashed line 72. In one form of second support 70, cross portions are provided which extend at least partially in a direction skewed relative to the longitudinal axis. As a specific example, cross members may comprise portions which extend in a direction perpendicular to the longitudinal axis 72. In FIG. 6, the cross members comprise a plurality of spaced apart parallel elongated cross members, some of which are indicated at 74, and which take the form of elongated bars. The bars 74 are inserted within the coil spring between the coils of the spring. The bars may extend partially or entirely across the coil spring. Desirably, the bars are of a shorter height than the coil spring. For example, for a coil spring which is 5½ inches high, the bars may be, for example, 2¾ inches high and 1 inch wide. As another example, for a coil spring which is 6½ inches high, the bars may be, for example, 3¾ inches high and 1 inch wide. Again, the size of these bars may be varied. These bars may be of the same material as the first support 59 and thus may have a greater density and greater resistance to compressibility than top pad 40 in this construction. The cross members need not all be of the same density and resistance to compressibility. Desirably, the second supports 70 are positioned at locations spaced inwardly from the ends of the mattress. As a result, greater support is provided at the central area of the mattress which tends to receive greater use than the ends of the mattress. This increases the durability of the mattress.

With the illustrated construction, one can open the valve 20 to permit the egress of air from the mattress. Air can then be removed from the mattress to compress the mattress. For example, pressure may be applied to the major surfaces of the mattress to compress the mattress, including the coil spring, and force air through the valve opening. The valve may then be closed. Because air cannot ingress into the mattress when the valve is closed, the foam and mattress will remain in its compressed state. Although proven to be unnecessary, the mattress may also be tied, placed into a sleeve or otherwise secured, to retain the coil spring in its compressed state. As a result, relatively bulky coil spring containing mattresses require much less space to ship. For example, at least 30 and more typically 30–40 mattresses may be stacked on top of one another on a conventional pallet for shipping in comparison to 8 mattresses which are uncompressed. This assumes the stacking of about 56 inches high as when compressed the mattresses are only about one and one-half inch high. (This is the FIG. 6 construction with a 4 inch tall spring, a top pad which is 1.5 inch thick and side and end supports having an upper surface at the same elevation as the upper surface of the top pad.) As a result, mattresses may economically be shipped over long distances.

Having illustrated and described the principles of my invention with respect to several embodiments, it should be apparent that these embodiments may be modified in arrangement and detail without departing from these principles. I claim all such modifications as fall within the scope and spirit of the following claims.

I claim:

1. A mattress comprising:

a coil spring comprising first and second major opposed surfaces;

at least one first foam pad at least partially overlaying the first major surface;

the first foam pad comprising open celled foam material capable of compression in response to the application pressure and expansion upon the relief of pressure;

a container comprised of a flexible material which contains and seals the coil spring and first foam pad within the container, the container being heat sealed to form a welded seam that is positioned at an elevation that is above one of the first and second major surfaces and below the other of the first and second major surfaces when the mattress is horizontal;

a valve coupled to the container and operable to permit the selective passage of air into the container to expand a compressed mattress;

at least one second foam pad at least partially overlying the second major surface, the second foam pad comprising open celled foam material capable of compression in response to the application of pressure and expansion upon the relief of pressure, wherein the second foam pad is also within the container;

comprising at least one first intermediate layer disposed at least partially between the first foam pad and the first major surface and at least one second intermediate layer disposed at least partially between the second foam pad and the second major surface and;

a first support comprised of open celled foam material so as to be compressible, the first support at least partially surrounding the coil spring and spacing the welded seam from the coil spring.

2. A mattress according to claim 1 wherein the first and second intermediate layers comprise a net.

3. A mattress according to claim 1 wherein the first and second intermediate layers comprise sheets comprised of fiber.

4. A mattress according to claim 3 wherein the sheets comprise at least two ounces per square inch non-woven sheets comprised of polymer fibers.

5. A mattress according to claim 1 wherein the first and second foam pads are of a material which compresses to twenty-five percent of its uncompressed thickness when subjected to a force in the range of from thirty-seven to forty-three pounds per square inch.

6. A mattress according to claim 1 wherein the first foam pad is comprised of fire retardant material and is capable of elongation in the amount of one hundred and twenty percent without tearing.

7. A mattress according to claim 1 in which the coil spring comprises first and second opposed sides and first and second opposed ends, the mattress comprising a first support extending about the sides and ends of the coil spring and positioned at least in part between the first and second foam pads.

8. A mattress according to claim 7 wherein the first intermediate layer has a periphery positioned at least in part between the first support and first foam pad and wherein the second intermediate layer has a periphery positioned at least in part between the first support and second foam pad.

9. A mattress comprising:

a coil spring comprising first and second major opposed surfaces;

at least one first foam pad at least partially overlaying the first major surface;

the first foam pad comprising open celled foam material capable of compression in response to the application pressure and expansion upon the relief of pressure;

a container comprised of a flexible material which contains and seals the coil spring and first foam pad within the container, the container comprising plural sheets of flexible material that are RF welded to form a seal to seal the coil spring and first foam pad within the container;

a valve coupled to the container and selectively operable to permit the ingress of air into the container to expand the mattress from a compressed condition; and wherein the coil spring comprises opposed sides extending between the first and second major surfaces and opposed ends extending between the first and second major surfaces, the mattress comprising a first support comprised of open celled foam and extending at least partially along the sides and ends of the coil spring and separating the seal from the coil spring.

10. A mattress according to claim 9 wherein: the container comprises plural sheets of material which are heat sealed along the perimeter of the mattress to form a perimeter seal.

11. A mattress according to claim 10 comprising at least one second foam pad at least partially overlying the second major surface, the second foam pad comprising open celled foam material capable of compression in response to the application of pressure and expansion upon the relief of pressure, wherein the second foam pad is also within the container.

12. A mattress according to claim 11 wherein the first and second foam pads are of a material which compresses to twenty-five percent of its uncompressed thickness when subjected to a force in the range of from thirty-seven to forty-three pounds per square inch.

13. A mattress according to claim 11 in which the first and second foam pads each have a cross-sectional area which is greater than the cross-sectional area of the first and second major surfaces.

14. A mattress according to claim 11 in which the first and second foam pads range in thickness from three-fourth inch to one and one-fourth inch.

15. A mattress according to claim 10 wherein the first foam pad is comprised of fire retardant material and is capable of elongation in the amount of one hundred and twenty percent without tearing.

16. A mattress according to claim 10 wherein the coil spring has a first width and wherein the first foam pad is of a width which is greater than the first width.

17. A mattress according to claim 9 wherein the first support entirely surrounds the sides and ends of the coil spring.

18. A mattress according to claim 9 in which the mattress has a longitudinal axis, the mattress further comprising a second support comprised of a foam material and having a cross portion extending at least partially in a direction which is skewed relative to the longitudinal axis.

19. A mattress according to claim 18 wherein the second support comprises plural spaced apart elongated cross members extending in a direction which is perpendicular to the longitudinal axis, and wherein the cross members extend at least a portion of the distance between the opposed sides of the coil spring.

20. A mattress according to claim 18 wherein the second support comprises plural support members positioned at locations spaced inwardly from the respective ends of the coil spring.

21. A mattress according to claim 18 wherein the second support is of a height which is less than the height of the coil spring.

22. A mattress according to claim 9 wherein the first support is comprised of a support material having a density which is greater than the density of the first foam pad and wherein the support material has a resistance to compression in response to applied pressure which is greater than the resistance of the first foam pad to compression in response to applied pressure.

23. A mattress comprising:

a coil spring comprising first and second major opposed surfaces, first and second side edges, and first and second end edges;

a first support comprising open celled foam material that at least partially surrounds the first and second side edges and first and second end edges;

at least one first pad at least partially overlaying the first major surface, the first pad comprising open celled foam material capable of compression in response to pressure and expansion upon the relief of pressure;

a container comprised of polymer material which contains and seals the coil spring, the first support and first pad within the container, the polymer material being RF welded to provide a seam that is spaced from the coil sprint by the first support, the seam being positioned at an elevation that is above one of the first and second major opposed surfaces and below the other of the first and second opposed major surfaces when the mattress is horizontal;

a valve coupled to the container and selectively operable to permit the ingress and egress of air into and out of the container to expand the mattress from a compressed condition;

the first pad having a cross-sectional area which is greater than the cross-sectional area of the first major surface, the first pad ranging in thickness from three-fourth inch to one and one-fourth inch, wherein the first pad is comprised of a material which compresses to twenty-five percent of its uncompressed thickness when subjected to a force in the range of from thirty-three to forty-three pounds per square inch; and the mattress further comprising at least one first intermediate layer disposed at least partially between the first foam pad and the first major surface and at least one second intermediate layer disposed at least partially overlying second major surface.

24. A mattress according to claim 23 wherein the first and second intermediate layers comprise a net which encases the coil spring.

25. A mattress according to claim 23 wherein the first and second intermediate layers comprise insulator sheets comprised of fiber.

26. A mattress according to claim 23 wherein the insulator sheets are at least two ounces per square inch non-woven fiber sheets comprised of polymer fibers.

27. A mattress according to claim 23 comprising a second pad comprised of a material which is like the material comprising the first pad, the second pad being positioned to at least partially overly the second major surface.

28. A mattress according to claim 23 comprising a second foam support comprising open celled foam material positioned within the coil spring.

29. A mattress comprising:

a coil spring having first and second opposed major surfaces, opposed sides and opposed ends;

a first compressible support comprised of open celled foam material at least partially surrounding the sides and ends of the coil spring;

a compressible pad overlaying the first major surface of the coil spring;

a sealed casing containing the coil spring, first compressible support and compressible pad, the sealed casing being RF welded to provide a seam in the casing that is spaced from the coil spring by the first support, the seam extending about the entire perimeter of the mattress at an elevation that is between the elevation of the first and second major surfaces when the mattress is horizontal; and a valve operable to selectively allow air to flow into the casing to expand the mattress from a compressed condition.

30. A mattress according to claim 29 comprising a second compressible support comprised of open celled foam material positioned within the interior of the coil spring.

31. A mattress according to claim 29 comprising a plurality of compressible cross members extending at least partially from side to side of the coil spring and of a height which is less than the height of the coil spring, the cross members being spaced inwardly from the respective ends of the coil spring.

32. A mattress according to claim 29 wherein the first compressible support entirely surrounds the sides and ends of the coil spring.

33. A mattress according to claim 29 wherein the first compressible support comprises side supports extending along the sides of the coil spring.

* * * * *